US005616365A

United States Patent [19]

Nealey

[11] Patent Number: 5,616,365

[45] Date of Patent: Apr. 1, 1997

[54] COATING METHOD USING AN INCLINED SURFACE

[75] Inventor: Richard H. Nealey, Penfield, N.Y.

[73] Assignee: Xerox Corporation, Stamford, Conn.

[21] Appl. No.: 660,720

[22] Filed: Jun. 10, 1996

[51] Int. Cl.[6] ..... B05D 1/18

[52] U.S. Cl. ..... 427/430.1; 118/404; 118/407; 118/408; 118/423

[58] Field of Search ..... 427/430.1; 118/407, 118/408, 423, 404

[56] References Cited

U.S. PATENT DOCUMENTS 4,610,942 9/1986 Yashiki et al. ..... 430/58

5,120,627 6/1992 Nozomi et al. ..... 430/59

5,279,916 1/1994 Sumino et al. ..... 430/134

5,422,144 6/1995 Speakman, Jr. ..... 427/430.1

*Primary Examiner*—Shrive Beck

*Assistant Examiner*—David M. Maiorana

*Attorney, Agent, or Firm*—Zosan S. Soong

[57] ABSTRACT

A method is disclosed for coating a substrate having an end region including: (a) positioning the substrate within a coating vessel to define a space between the vessel and the substrate and providing a downwardly inclined surface contiguous to the outer surface at the end region of the substrate; (b) filling at least a portion of the space with a coating solution; and (c) withdrawing the coating solution from the space, thereby depositing a layer of the coating solution on the substrate.

11 Claims, 3 Drawing Sheets

COATING METHOD USING AN INCLINED SURFACE

BACKGROUND OF THE INVENTION

This invention relates to a coating method, which may be considered a type of dip coating, for use in fabricating for instance photosensitive members, wherein the use of an inclined surface adjoining the substrate minimizes the size of the coating bead or eliminates the coating bead. The term bead refers to a coating buildup such as an excessively thick portion of the coating on the substrate.

Dip coating is a coating method typically involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed. A bead may be formed during dip coating on the bottom end region of the substrate, especially at the bottom edge, where the bead covers a portion of the outer and inner surface of the bottom end region. The bead can be quite large such as from about 100 to 250 microns in thickness (measured from the substrate surface) and from about 3 to 10 mm in width (measured along the length of the substrate). The time required for ambient conditions to partially dry the bead to a tacky film, which is then sufficiently dry for the next coating solution without danger of contaminating that coating solution, may be in excess of about 90 minutes. Such a long time period may be needed because the bead is generally much thicker than the rest of the coated layer and because ambient air cannot freely circulate within the substrate interior to evaporate solvent from the portion of the wet coating solution bead on the inside surface of the substrate. This is a problem since there may be less than 90 minutes between dip coating cycles in certain production processes and thus the insufficiently dry bead will contaminate the coating solution in the next dip coating vessel. Consequently, there is a need, which the present invention addresses, for a coating method which decreases the size of the coating bead or eliminates the coating bead, thereby resulting in a coated layer at the substrate end region which is not excessively thicker than the coated layer over the rest of the substrate.

The following documents disclose conventional coating methods, dip coating apparatus, and photosensitive members:

Speakman, Jr., U.S. Pat. No. 5,422,144, discloses a substrate coating method employing a sleeve member.

Yashiki et al., U.S. Pat. No. 4,610,942, discloses an electrophotographic member having corresponding thin end portions of charge generation and charge transport layers;

Nozomi et al., U.S. Pat. No. 5,120,627, discloses an electrophotographic photoreceptor having a dip coated charge transport layer; and Sumino et al., U.S. Pat. No. 5,279,916, discloses a process for producing an electrophotographic photosensitive member.

SUMMARY OF THE INVENTION

The present invention is accomplished in embodiments by providing a method for coating a substrate having an end region comprising:

(a) positioning the substrate within a coating vessel to define a space between the vessel and the substrate and providing a downwardly inclined surface contiguous to the outer surface at the end region of the substrate;

(b) filling at least a portion of the space with a coating solution; and (c) withdrawing the coating solution from the space, thereby depositing a layer of the coating solution on the substrate.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
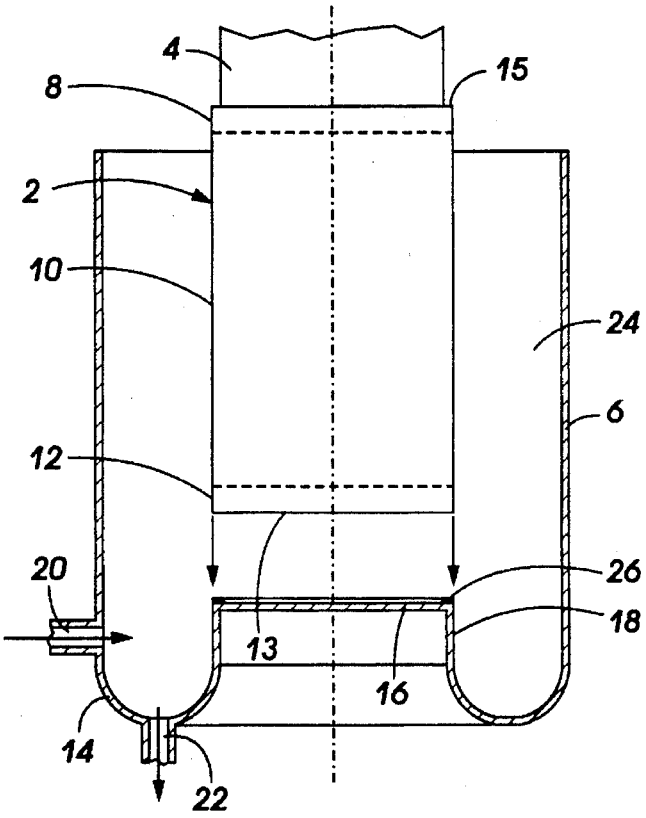
FIG. 1 represents a schematic, side view in partial cross-section of a substrate being moved into position in a coating vessel.

FIG. 1 illustrates a substrate 2 being moved by chuck assembly 4 into position inside the coating vessel 6. The substrate may be employed in the fabrication of photosensitive members wherein each substrate preferably has a hollow, endless configuration and defines a top region 8 (a non-imaging area), a center region 10 (an imaging area), and an end region 12 (a non-imaging area). The precise dimensions of these three substrate regions vary in embodiments. As illustrative dimensions, the top region ranges in length from about 10 to about 50 mm, and preferably from about 20 to about 40 mm. The center region may range in length from about 200 to about 400 mm, and preferably from about 250 to about 300 mm. The end region may range in length from about 10 to about 50 mm, and preferably from about 20 to about 40 mm. For those embodiments where the substrate has a hollow, endless configuration with open ends, the end region 12 defines a bottom end 13, the top region 8 defines a top end 15, and the various surfaces of the substrate include an outer surface, an inner surface within the substrate interior, and end edges.

Any suitable chuck assembly can be used to hold the substrate including the chuck assemblies disclosed in Mistrater et al., U.S. Pat. No. 5,320,364, and Swain et al., U.S. application Ser. No. 08/338,062 (D/94573), the disclosures of which are hereby totally incorporated by reference.

The coating vessel defines a channel 14, wherein the channel delineates a projecting member 16. The inclined surface 18 is defined wholly or partly by the sides of the projecting member 16. A solution entrance 20 and a solution exit 22 are indicated. A space 24 is defined between the outer surface of the substrate 2 and the inner surface of the vessel 6. In certain embodiments, the projecting member 16 can be a separate piece which is disposed inside the vessel. A seal member 26 may be present in any of the embodiments described herein to facilitate a fluid tight seal between the projecting member and the substrate. The outer surface of the seal member may form a pan of the inclined surface. The seal member is preferably made of a compressible material to insure that no coating solution penetrates to the interior of the substrate. The composition of the seal member is chosen to be compatible with the solvent used in the coating operation. Examples of suitable materials for the seal member include fluorocarbon, ethylene-propylene copolymer, nitrile (Buna N), and KEVLAR™.

Figure 2:
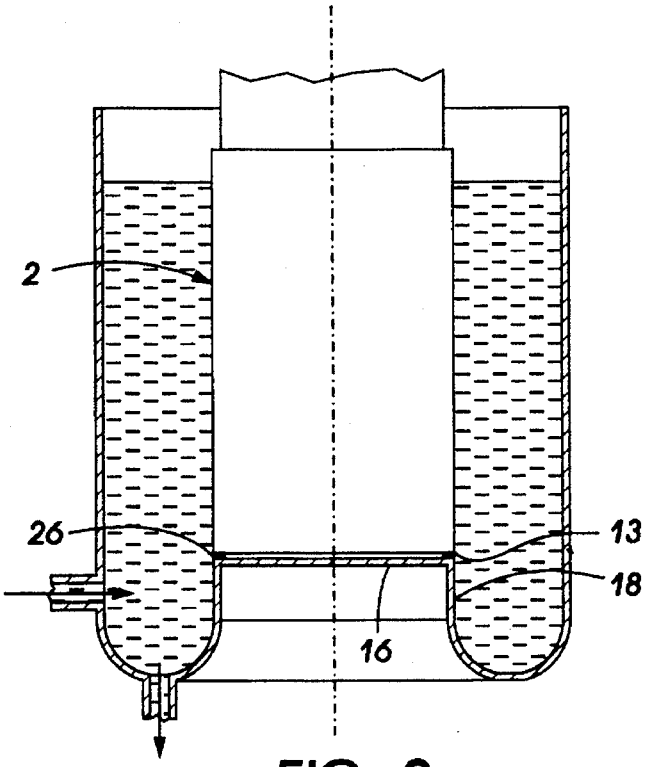
FIG. 2 represents a schematic, side view in partial cross-section of the apparatus of FIG. 1 during the coating process.

In FIG. 2, the substrate 2 preferably forms a fluid tight seal with the projecting member 16 via the seal member 26 to prevent entry of the coating solution into the substrate interior. The inclined surface 18, which is depicted with a vertical slope, is contiguous to the bottom end 13 of the substrate, wherein the inclined surface 18 is defined by the outer surface of the seal member 26 and by the sides of the projecting member 16. The substrate is preferably positioned vertically in the vessel.

Figure 3:
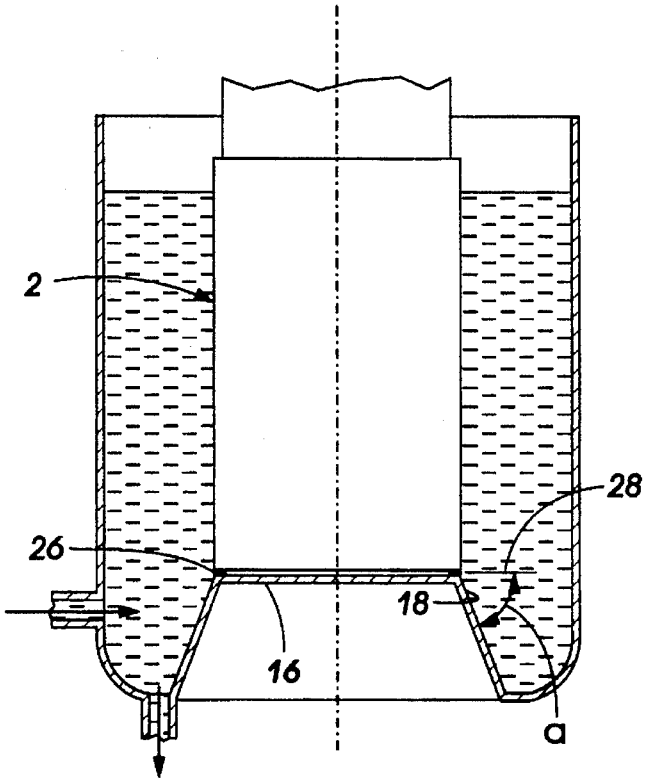
FIG. 3 represents a schematic, side view in partial cross-section of an alternative embodiment of the apparatus depicted in FIG. 2.
Figure 4:
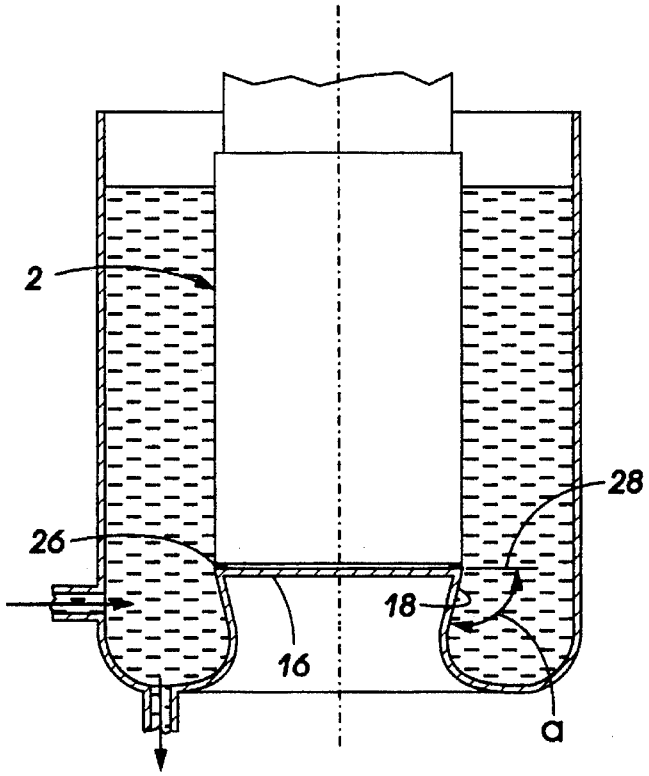
FIG. 4 represents a schematic, side view in partial cross-section of another embodiment of the apparatus depicted in FIG. 2.

FIG. 3 and FIG. 4 illustrate other slopes of the inclined surface 18 as measured from an imaginary line 28 perpendicular to the outer surface of the end region, wherein the inclined surface 18 and the imaginary line 28 define an angle a.

Figure 5:
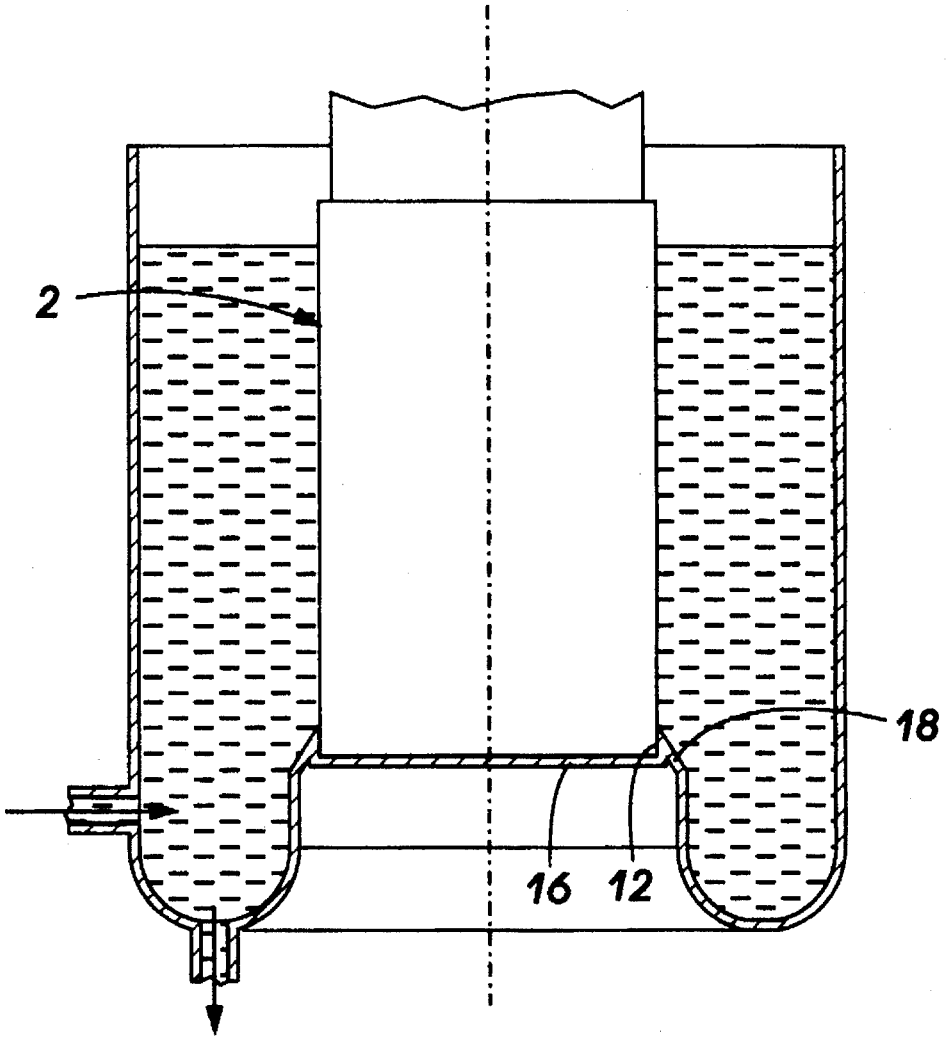
FIG. 5 represents a schematic, side view in partial cross-section of still another embodiment of the apparatus depicted in FIG. 2

FIG. 5 illustrates an embodiment where the inclined surface 18 via the projecting member 16 masks a portion of the outer surface of the end region 12 to prevent deposition of the coating solution layer over the masked portion. Preferably, the inclined surface 18 in FIG. 5 has a sharp edge so as to provide a well defined pathway for the flow of the coating solution.

The inclined surface may be composed of the outer surfaces of any number of adjoining members such as for example the projecting member alone, the projecting member with the seal member, or the projecting member in combination with the seal member and one or more other devices. The inclined surface has a slope ranging for example from about 30 to about 160 degrees, preferably from about 45 to about 130 degrees, and especially about 90 degrees, as measured from an imaginary line perpendicular to the outer surface of the end region. The inclined surface facilitates the flow of coating solution away from the outer surface at the end region of the substrate, thereby minimizing the formation of a coating solution bead on the outer surface at the end region of the substrate. Gravity will move the coating solution on the substrate in a downwards direction and the inclined surface provides a solution pathway which prevents a coating solution buildup at for example the substrate bottom end which would occur in the absence of the inclined surface.

The outer surface of the substrate may be separated from the inner surface of the vessel at any suitable distance ranging for example from about 5 mm to about 5 cm, and preferably from about 10 mm to about 3 cm. The volume of the space ranges for example from about 20 cc to about 200 cc. At least a portion of the space, preferably the entire space, between the substrate and the inner surface of the vessel is filled with a coating solution via for example the solution entrance. The coating solution is withdrawn from the space via for example the solution exit. The coating solution is withdrawn at a rate so that the surface of the coating solution decreases at a rate ranging for example from about 50 to about 500 mm/min, and preferably from about 100 to about 400 mm/min.

The substrate may be coated with a plurality of layers by repeating the steps of filling at least a portion of the space with the respective coating solution and withdrawing the respective coating solution from the space, thereby forming a new layer over the previous layer or layers on the substrate. The deposition of the plurality of the layers may be accomplished without moving the substrate from the vessel. It is preferred to introduce a gas such as air into the space after withdrawal of the first coating solution from the space but prior to filling of the space with the second coating solution to at least partially dry the layer of the first coating solution on the substrate and any remaining first coating solution in the coating vessel. Preferably, all of the remaining first coating solution are dried prior to introduction of the second coating solution in the vessel. The use of the drying gas may avoid contamination of the subsequent coating solution from insufficiently dry or wet residues of the previous coating solution. The drying gas may be for example air and the gas may have a temperature higher than room temperature such as a temperature ranging for instance from about 30 to about 70 degrees C. The drying gas should be gently introduced at a pressure ranging for example from about 10 to about 30 psi to avoid disrupting the coated layer.

The thickness of each wet coated layer on the substrate may be relatively uniform and may be for example from about 10 to about 40 microns in thickness, including the portion of the coated layer over the end region. Preferably, the portion of the coated layer over the end region should not be execessively thicker than the rest of the coated layer using the present invention.

The present invention accomplishes one or more of the following benefits: minimizes or eliminates the coating solution bead on the end region of the substrate; minimizes the volume of coating solution needed to coat substrates; quick and easy changeover of coating solutions and substrates; minimizes the contamination and coating defects by the use of a clean drying gas system within the vessel; ability to accommodate a substrate having either a drum configuration or a flexible seamless belt configuration without resorting to ellipses or other shapes that may induce unwanted strains in the coated substrate; and ease of control of process parameters and minimization of solvent emission into the atmosphere.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 30 microns, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like. The substrates preferably have a hollow, endless configuration.

Each coating solution may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

In embodiments, a coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating layer coating solution comprises: 2% by weight hydroxy gallium phthalocyanine; 1% by weight terpolymer of vinyl acetate, vinyl chloride, and maleic acid; and 97% by weight cyclohexanone.

In embodiments, a coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport layer coating solution has the following composition: 10% by weight N,N'-diphenyl-N,N'-bis(3-methylphenyl)-[1,1'-biphenyl]-4,4'diamine; 14% by weight poly(4,4'-diphenyl-1,1'-cyclohexane carbonate (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100° to about 160° C. for about 0.2 to about 2 hours.

Other modifications of the present invention may occur to those skilled in the art based upon a reading of the present disclosure and these modifications are intended to be included within the scope of the present invention.

What is claimed is:

1. A method for coating a substrate having an end region comprising:

(a) positioning the substrate within a coating vessel to define a space between the vessel and the substrate and providing a downwardly inclined surface contiguous to the outer surface at the end region of the substrate;

(b) filling at least a portion of the space with a coating solution; and (c) withdrawing the coating solution from the space, thereby depositing a layer of the coating solution on the substrate.

2. The method of claim 1, wherein (a) is accomplished by positioning the substrate vertically within the coating vessel.

3. The method of claim 1, wherein the end region of the substrate defines a bottom end and the inclined surface is contiguous to the bottom end.

4. The method of claim 1, wherein the coating solution is a charge generating material.

5. The method of claim 1, wherein the coating solution is a charge transport material.

6. The method of claim 1, wherein the inclined surface has a vertical slope.

7. The method of claim 1, wherein the inclined surface has a slope ranging from about 30 to about 160 degrees as measured from an imaginary line perpendicular to the outer surface of the end region.

8. The method of claim 1, wherein a projecting member and a seal member define the inclined surface and further comprising forming a fluid tight seal between the projecting member and the substrate.

9. The method of claim 1, further comprising (d) filling at least a portion of the space with a second coating solution; and (e) withdrawing the second coating solution from the space, thereby forming a layer of the second coating solution on the substrate.

10. The method of claim 9, further comprising between (c) and (d) introducing a gas into the coating vessel to at least partially dry the layer and any remaining coating solution.

11. The method of claim 1, wherein the inclined surface masks a portion of the outer surface of the end region to prevent deposition of the coating solution layer over the masked portion.

* * * * *